United States Patent [19]

Smith

[11] Patent Number: 4,855,042

[45] Date of Patent: Aug. 8, 1989

[54] APPARATUS FOR MINIMIZING REACTIVE FORCES ON A GIMBAL-MOUNTED CENTRIFUGE

[75] Inventor: Lloyd B. Smith, Bristol, Tenn.

[73] Assignee: The United Company, Bristol, Va.

[21] Appl. No.: 183,430

[22] Filed: Apr. 18, 1988

Related U.S. Application Data

[63] Continuation-in-part of Ser. No. 941,290, Dec. 12, 1986, abandoned.

[51] Int. Cl.[4] ..... B04B 1/06

[52] U.S. Cl. ..... 210/144; 210/360.1; 210/363; 494/36; 494/84

[58] Field of Search ..... 68/23.2; 74/573 R; 210/739, 787, 144, 145, 781, 360.1, 363, 376, 379; 494/36, 46, 37, 82–84

[56] References Cited

U.S. PATENT DOCUMENTS

| | | | |
|---|---|---|---|
| 2,450,592 | 5/1947 | Gerhardt | 210/363 |
| 3,362,198 | 1/1968 | Barito | 210/363 |
| 3,683,647 | 8/1972 | Coshow | 68/23.2 |
| 3,796,109 | 3/1974 | Lagerwey | 496/46 |
| 4,096,988 | 6/1978 | Scuricini | 74/573 R |
| 4,458,554 | 7/1984 | Hrastar | 74/573 R |
| 4,639,320 | 1/1987 | Smith | 210/739 |
| 4,640,770 | 2/1987 | Smith | 210/363 |

FOREIGN PATENT DOCUMENTS

| | | | |
|---|---|---|---|
| 2527110 | 12/1976 | Fed. Rep. of Germany | 494/46 |
| 60-22215 | 5/1985 | Japan | 68/23.2 |

*Primary Examiner*—Peter Hruskoci

*Attorney, Agent, or Firm*—Jennings, Carter, Thompson & Veal

[57] ABSTRACT

A neutralizer ring for dynamically balancing a gimbal-mounted overhung centrifuge, wherein the neutralizer ring must have a particular mass and location in accordance with the parameters of a given system and a method for determining the mass and location of said system by iterative manipulation of the mass and location.

3 Claims, 1 Drawing Sheet

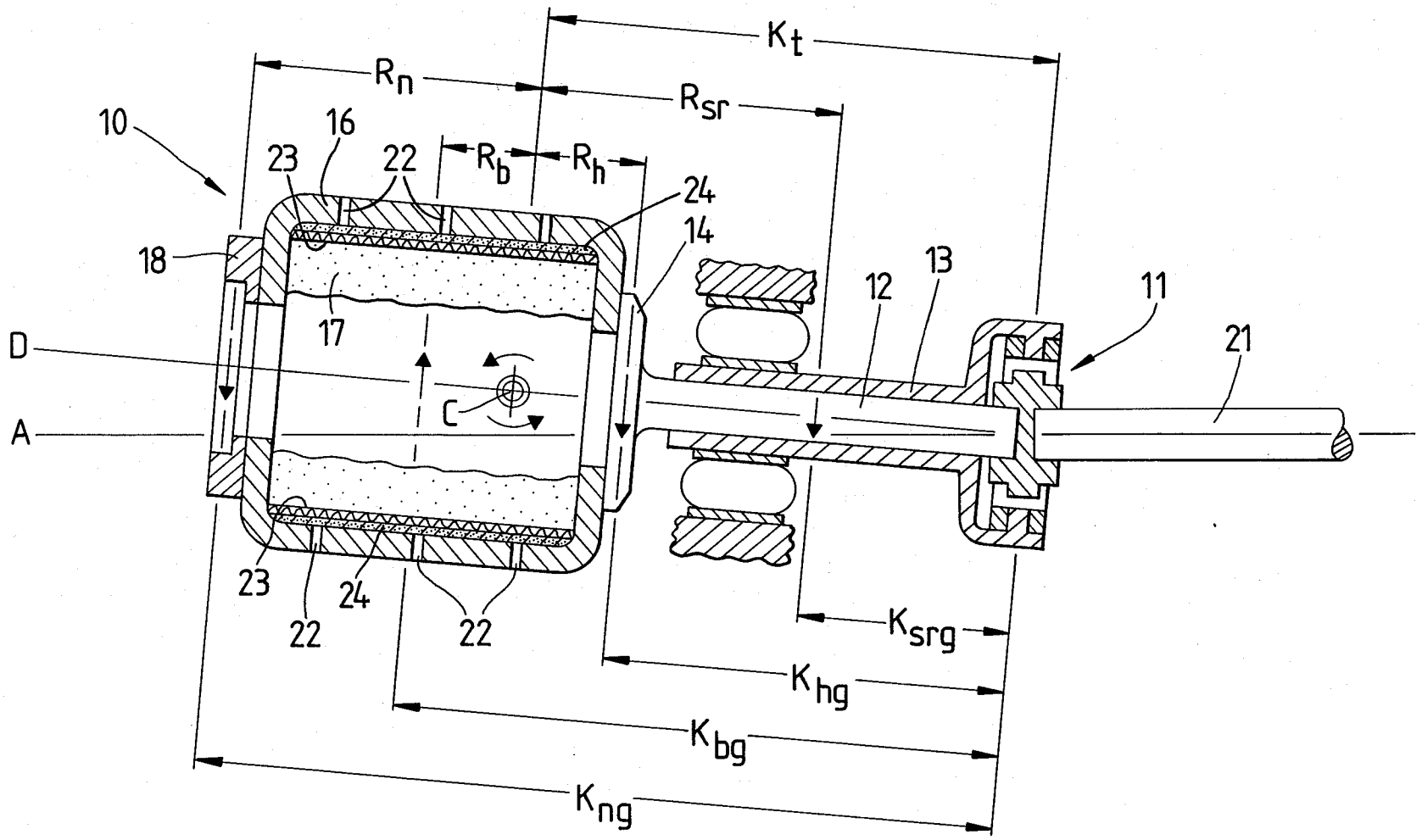
21
11
13
12
$K_t$
$R_{sr}$
24
14
$R_h$
$R_b$
$R_n$
22
16
23
17
18
10
D
A
C
$K_{srg}$
$K_{hg}$
$K_{bg}$
$K_{ng}$

APPARATUS FOR MINIMIZING REACTIVE FORCES ON A GIMBAL-MOUNTED CENTRIFUGE

This application is a continuation-in-part of U.S. Ser. No. 941,290 filed Dec. 12, 1986, now abandoned.

FIELD OF THE INVENTION

The present invention relates generally to centrifuges and more particularly to centrifuges wherein high speeds are attained through the use of a light-weight composite bowl mounted on a gimbal-mounted shaft. Even more particularly, the present invention relates to a method and apparatus for dynamically balancing such a centrifuge when an unbalanced load therein causes deviation between the geometric axis of the centrifuge and the dynamic axis of the centrifuge.

BACKGROUND OF THE INVENTION

The present invention provides an improvement in the operation of a centrifuge employing the teaching of my co-pending applications Ser. Nos. 831,055 and Ser. No. 831,056 now U.S. Pat. Nos. 4,640,770 and 4,639,320, respetively. The teachings of these applications enable a gimbal-mounted centrifuge to transit the critical speeds of rotation of a centrifuge with little transfer of energy to the gimbal-like structure in which the rotor is mounted, and provide the structure necessary to successfully operate a high speed overhung bowl centrifuge, consequently these applications are incorporated herein by reference.

In a centrifuge of the type with which my invention is intended for use, the rotating elements are dynamically balanced such that at high speed operation, above the critical speeds, the elements tend to rotate about their geometric longitudinal axis and develop a moment of inertia of $WK^2$, where W is the mass (although weight is used in some calculations for simplicity) and K is the radius of gyration of the elements about the axis. When a quantity of centrifuge load material is placed within the centrifuge bowl, the distribution is likely to be unbalanced, thus the unbalanced load causes a radial deviation of the rotating system which causes the system to rotate about a dynamic axis. The radial deviation of the spinning mass results in gyroscopic torque being applied to the system. Thus, the system is subjected to competing stresses which yield a reactance on the gimbal-like mounting system. If this reactance or force is excessive, the gimbal-like mount is soon destroyed.

The deviation of the dynamic axis of rotation from the geometric axis of the rotating system has long been a concern of centrifuge designers, however, a satisfactory solution which will minimize the effects of an unbalanced condition on a gimballed centrifuge is not previously known.

Numerous patents have issued on dynamic balance systems for centrifugal extractors, such as washing machines and the like, wherein the rotor is mounted in fixed bearings. Some of these such as U.S. Pat. Nos. 2,420,592 and 3,683,647 use movable members mounted in association with the tub or bowl which are said to automatically compensate any unbalanced load. The most pertinent reference known to me is U.S. Pat. No. 3,362,198 wherein a balancing ring is used to counter dynamic imbalance in a loaded clothes washer, however, the rotator is not gimbal mounted and the machine disclosed therein operates under considerably different constraints than does my centrifuge. Most notably the balance ring of the '198 patent is not designed for use with a gimballed system, nor at the speeds at which my centrifuge operates. Furthermore, from the disclosure, it appears that the balance ring is quite massive relative to the remainder of the system, contrary to my invention as is hereinafter disclosed.

SUMMARY OF THE INVENTION

It is the object of this invention to dynamically balance a gimballed centrifuge having a known capacity while the centrifuge is rotating at speeds above the critical or resonant speeds.

Yet another object of the invention is to provide a method for designing a centrifuge that remains in balance at its drying speeds.

Still another object of the invention is to provide a gimballed centrifuge of improved longevity and reliability due to the reduced reactive stress placed on the gimbal.

Yet another object of the invention is to enable the use of a light-weight composite bowl in a high speed centrifuge.

These and other objects and advantages derived from my invention are accomplished through the location of and definition of a balancing mass whose weight is substantially less than the weight of the centrifuge bowl and its contents. As noted herein above in the centrifuge disclosed in co-pending application Ser. No. 831,055, utilizes a gimbal-like drive connection to power a shaft which turns in a bearing supported on a plurality of bearings of variable resiliency. An overhung bowl is connected to the shaft at a hub such that the shaft and bowl are free to undergo limited radial displacement without inducing severe bending stresses on either the bowl or shaft. As noted however, when an unbalanced load is introduced into the bowl, the combined mass of the bowl and load exert an undesirable centrifugal force which induces a radial displacement at a velocity sufficient to generate a reactive force o the gimbal of an undesirable magnitude. This is particularly true when the bowl is made of a light-weight composite material.

My invention utilizes the propensity of the system to induce reactive forces on the gimbal responsive to the unbalanced condition, as if the unbalanced system were a mass $W_t$ located at a radius of gyration $K_t$ relative to the gimbal. For a given rotating system having a known capacity, known operating speed and known masses and location of its components, I have determined a method for locating and defining a neutralizer ring which will minimize the reactive force on the gimbal by causing the geometric axis of the system and the instantaneous dynamic axis of the system to be aligned at the gimbal. To determine the reactive force on the gimbal without my invention, the moment of inertia ($WK^2$) of each component relative to the gimbal is determined and summed to yield the total (WK2)t from which the system radius of gyration $K_t$ relative to the gimbal is determined. With a known maximum radial displacement, the gyroscopic effect at the radius of gyration $K_t$ can be calculated and the first moment of each component relative to a point at $K_t$ can be calculated. The sum of the first moments and the gyro effect are used to determine the resultant force on the gimbal. In the unbalanced condition using a composite bowl, the force on the gimbal at operating speeds will be excessive, leading to failure of the gimbal or the shaft.

Therefore a neutralizing ring must be located and sized such that the combined torque from the mass and gyro effect of the neutralizer ring about the point $K_t$ must be equal and opposite in direction to the torque induced by all the other masses in the system. In determining the torque induced by the other masses, it is apparent that the neutralizer ring must be located outwardly beyond $K_t$. Thus the neutralizer ring must have a diameter acceptable to the size of the bowl, which limits the possible radius of gyration $K_{na}$ of the neutralizer ring relative to the axis. Thus the solution to the problem is the optimization of three variables, the weight of the neutralizer ring ($W_n$), the radius of gyration of the neutralizer ring relative to the gimbal ($K_{ng}$), and the radius of gyration of the neutralizer ring relative to the axis of the system ($K_{na}$), and the deployment of the neutralizer ring in accordance therewith.

DESCRIPTION OF THE DRAWING

The Figure is a vertical sectional view of a centrifuge system with my neutralizer ring mounted about the opening of the bowl.

DESCRIPTION OF A PREFERRED EMBODIMENT

Referring to the Figure, a rotor system 10 of a centrifuge such as described in my co-pending application Ser. No. 831,055 which is incorporated herein by reference is shown pictorially with much of the support structure eliminated for clarity. The rotor system 10 has a geometric or rest axis indicated at A about which it should rotate if perfectly balanced. Input power for rotation is accomplished via an input drive shaft 21 driven by a suitable source of power, not shown, and a gimbal-like connection 11 which transmits power to a drive shaft 12 which rotates in a bearing sleeve 13 supported on a suspension of variable resiliency as described in Ser. No. 831,055. A hub 14 affixed to the shaft 12 supports an overhung bowl 16, made of a light-weight composite material. The bowl 16 preferentially has a plurality of radially directed apertures 22 therein, through which filtrate is extracted after having passed through an appropriately sized filter media 23 and a pervious support 24 for said filter media 23.

The rotor system 10 is depicted as having undergone a deflection at an exaggerated angle such that the instantaneous dynamic axis is indicated at D. It is to be understood that the Figure is an instantaneous representation of the rotor system 10 which in reality would describe an orbit about the geometric axis A. It is also to be understood that the rotor system 10 can be modeled by a set of masses and appropriate radii of gyration. Consequently, the shaft 12 may be considered to have a mass $M_s$, a radius of gyration about the gimbal denoted by $K_{sg}$ and a radius of gyration about the geometric axis A, $K_{sa}$; the hub has a mass $M_h$, and radius of gyration of $K_{hg}$ and $K_{ha}$; the bowl and load have a combined mass $M_b$, radius of gyration $K_{bg}$ and $K_{ba}$; the bearing has a mass $M_r$ and a radius of gyration $K_{rg}$ about the gimbal. To avoid confusion, the radii of gyration relative to the geometric axis are not designated in the Figure, however it is to be understood that they are physical dimensions which can readily be determined from the geometry of the centrifuge.

While my invention may be used with any centrifuge having an overhung bowl and gimbal-mounted rotor system, it is particularly useful with a light-weight, high strength composite bowl which has a mass less than a mass of particulate 17 centrifuged therein. For purposes of illustration, such a system is described and referred to throughout the remainder of the application.

In my exemplary system, the weight of the components rather than the mass will be used in description and formula, for the sake of simplifying the discussion. The particulate 17 and bowl have a combined weight of 1100 lbs., the hub 14 has a weight of 225.2 lbs., the shaft 12 has a weight of 159.8 lbs., and the weight of the bearing 13 is 239.7 lbs. The product of the weight of each component and the square of the radius of gyration about the axis, $WK^2$, is derived from the physical geometry of each component resulting in the following values:

| Component | $WK^2$ # $ft^2$ re axis |
|---|---|
| Bowl & Load | 1925 |
| Hub | 172 |
| Shaft | 3.5 |

Also known are: the RPM of the system N=2400, the maximum radial displacement at the geometric center of the bowl R=0.050 in., and the radius of gyration for each component about the gimbal connection 11, which are $K_{srg}$=17.2 in. for the shaft 12 and bearing 13 combination, $K_{bg}$=58.2 in. for the bowl 16 and particulate 17 combination and $K_{hg}$=34.1 inches for the hub.

With these values known, the total $WK^2$ of the system with respect to the gimbal can be determined by summing the $WK^2$ of the components as shown in Table 1.

TABLE 1

| Component | Weight | Kg | $WK^2$ |
|---|---|---|---|
| Bowl & Particulate | 1100 | 58.2 in. | 3,725,924 lb. in.$^2$ |
| Hub | 285.2 | 34.1 in. | 331,633 lb. in.$^2$ |
| Shaft & Bearing | 399.5 | 17.2 in. | 118,188 lb. in.$^2$ |
| | 1784.7 | | 4,275,745 lb. in.$^2$ |

From the above totals, the radius of gyration of the system relative to the gimbal, $K_t$, may be calculated by $$K_t = \left(\frac{WK^2}{W}\right)^{\frac{1}{2}} = \left(\frac{4{,}275{,}745}{1784.7}\right)^{\frac{1}{2}} = 48.95 \text{ in.}$$

This radius of gyration $K_t$ is taken to be the point in the system at or about which all of the reactive forces act including the gyroscopic force P induced by the deflection of the unbalanced load.

Thus the sum of the first moments of the components about a point C located at $K_t$ and the gyroscopic effect must be determined to determine the force acting on the gimbal due to the unbalanced condition. These first moments are taken about point C at $K_t$ such that clockwise moments are considered + and counter clockwise −.

To determine the first moment of each component, determine the radial throw at its radius of gyration relative to the gimbal using the proportion $$R_t = .050 \times \frac{K_g}{R}$$

where $K_g$ is the radius of gyration of the included component relative to the gimbal and R is the distance from the gimbal to the geometric center of the bowl, 56.7 inches.

The number of gravities for each item is calculated from the relation $a \cdot R_t N^2$ where a is a constant. Thus the force exerted by each item is the product of the components weight and the specific gravities.

The moment arm for each component is determined by the relation $R_g = K_g - K_t$, where $R_g$ is the moment arm of each component. A speeds above the natural frequency, each balanced component exerts its force toward the axis of rotation whereas the unbalanced load exerts a force away from the axis consequently.

Table 2 shows the summation of the moments about $K_t$.

TABLE 2

| Component | Radial Throw | g's | Weight lb. | Force lb. | Mom. Arm in. | Moment lb. in. |
|---|---|---|---|---|---|---|
| Bowl & Load | .051 | 8.35 | 1100 | 9125 | 9.25 | 84,406 |
| Hub | .030 | 4.91 | 282.2 | 1400.3 | 14.85 | 20,794 |
| Shaft & Bearing | .015 | 2.4 6 | 399.5 | 982.8 | 31.75 | 31,204 |
| | | | | | | 136,404 |

Additionally, the gyro precessional torque $P_{kt}$ of the rotating components is determined and summed with the first moments using the expression $$P_{kt} = \left(\frac{W}{g}\right)(K_r^2)\left(\frac{N}{30}\right)\left(\frac{V}{K_t}\right)$$

where V is the linear velocity of a point on the axis at $K_t$ from the gimbal and W is the weight of the rotating parts and $K_r$ is the radius of gyration of the rotor system relative to the axis thereof.

Since the instantaneous linear velocity of the point is tangent to the orbit of the dynamic axis, the resultant gyroscopic precessional torque is directed toward the geometric axis at $K_t$ and has a magnitude of −46783,12 lb. ins., thus the sum of the first moments and precessional torque at $K_t$ is 89621 lb. in. and the force on the gimbal as a result is $$F = \frac{\Sigma \text{ moment} + \text{Gyro effect}}{K_t}$$

$$F = \frac{89{,}621 \text{ lb. in.}}{48.95} = 1831 \text{ lbs.}$$

which is sufficient to damage the centrifuge.

From the analysis of the moments of force about $K_t$, it can be seen that a counter-balancing moment of force is required to neutralize the effect of the unbalanced load and that the mass needed must be located at a distance greater than $K_t$ from the gimbal. To minimize the required mass, a balanced ring 18 may be placed about the mouth of bowl 16. The neutralizer ring 18 is to be affixed to the composite bowl 16 in any manner which may be convenient. In the described example, this will locate the ring at a radius of gyration $K_{ng}$ about the gimbal of 78.5 inches. Of course, the addition of the neutralizer ring 18 changes the $WK^2$ of the entire system so each of the preceeding calculations must be performed to optimize the mass. The radius of gyration of the neutralizer ring 18 about the gimbal is constrained by the displacement of the bowl opening from the gimbal and the radius of gyration of the neutralizer ring 18 about the axis is constrained by the size of the bowl opening. From the foregoing it may be seen that the diameter of the ring 18 has a lower limit defined by the size of the bowl opening. The thickness and outer diameter of the ring 18 are dimensions which can be varied to locate the center of mass at the desired $K_{na}$ and $K_{ng}$. Therefore the most easily changed variable is the mass of the ring, although both $K_{na}$ and $K_{ng}$ can be varied by varying the geometry of the bowl. The mass of the ring 18 is varied by the selection of the ring material, which may be any material which can be formed into a solid ring and which will withstand the forces generated by the centrifuge, and by the physical dimensions selected for the ring. Note that the ring is fixed relative to the bowl such that it moves concomitantly therewith.

Table 3 provides the relationship between the mass of the neutralizer ring 18 and the force exerted on the gimbal when $K_{ng}$ is taken to be 78.5 inches.

TABLE 3

| Weight of Neutralizer Ring | $WK^2$ of Ring # ft.$^2$ | First Moment # in. | Gimbal Reaction # |
|---|---|---|---|
| Zero | Zero | 89,621 | 1831 |
| 200 | 253 | 6,781 | 130 |
| 218 | 275.4 | −519 | −10 |
| 220 | 277.9 | −1,276 | −24 |
| 225 | 284.4 | −3,156 | −60 |
| 230 | 290.7 | −5,236 | −99 |
| 300 | 379.0 | −40,718 | −713 |

From Table 3, it should be apparent that it is insufficient to simply place a balanced ring outwardly of the mouth of the bowl 10. Rather the ring must be of a particular mass according to the weight of the system which it must neutralize and it must be located appropriately. For example, if the mass were held constant at 218 lbs. and the radius of gyration $K_{ng}$ were extended or shortened by 2 inches, the force on the gimbal would increase to in excess of 115 lbs. which would severely stress the gimbal.

It may thus be seen that by using my method a neutralizer ring may be constructed which will effectively minimize the reactive force on the gimbal of the system and thus greatly enhance the useful life of the gimbal mounted centrifuge.

While I have shown my invention in one form, it will be obvious to those skilled in the art that it is not so limited but is susceptible of various changes and modifications without departing from the spirit thereof.

What I claim is:

1. In a centrifuge for extracting fluids from wet particulate matter wherein said centrifuge includes a rotor system with an overhung composite bowl having an opening at one end thereof and a base at the other end, with a filter media liner proximal the inner surface thereof and a plurality of outlet ports therethrough for the outward discharge of said fluids and a continuous shaft fixed to said base at one end and driven for rotation at a gimbal-like mounting at a second end, with said shaft and said bowl being resiliently supported on bearings located intermediate said gimbal-like mounting and said bowl, the improvement comprising a neutralizer ring affixed about said bowl at the opening thereof and being dynamically balanced, with said ring having a weight, W, and a radius of gyration, $K_{ng}$, about said gimbal-like mounting such that said neutralizer ring neutralizes the effects of imbalance in a predetermined weight of said particulate matter and causes the geometric axis and the instantaneous dynamic axis of the rotor system to intersect at said gimbal-like mounting thereby reducing reactive forces exerted on said gimbal-like member.

2. The improvement as defined in claim 1 wherein said neutralizer ring is located a distance, d, from the radius of gyration, $K_t$, of said rotor system about said gimbal-like mounting such that the first moment of force due to the neutralizer ring about a point on the axis of the rotor system at said radius of gyration, $K_t$, acts in opposition to the first moment of force due to said particulate matter about said point such that the sum of the gyroscopic precessional torque and the first moments of force about said point due to said rotor system, neutralizer ring and particulate matter is minimized.

3. In a centrifuge for extracting fluids form wet particulate matter wherein said centrifuge includes a rotor system with an overhung composite bowl having an opening at one end thereof and a base at the other end, with a filter media liner proximal the inner surface thereof and a plurality of outlet ports therethrough for the outward discharge of said fluids and a continuous shaft fixed to said base at one end and driven for rotation at a gimbal-like mounting at a second end, with said shaft and said bowl being resiliently supported on bearings located intermediate said gimbal-like mounting and said bowl, the improvement comprising an annular ring affixed about the opening of said bowl distal said gimbal-like mounting with said ring having an effective diameter, mass, and moment of inertia thereof, WK2, such that when said rotor system is operating above the natural frequency of vibration thereof the annular ring gates minor imbalance in said particular te matter in said centrifuge and causes the geometric axis and the instantaneous dynamic axis of said rotor system to intersect at said gimbal-like mounting, where W is the weight of the ring and K is the radius of gyration of the ring relative to the geometric axis of the system.

* * * * *

UNITED STATES PATENT AND TRADEMARK OFFICE

CERTIFICATE OF CORRECTION

PATENT NO. : 4,855,042

DATED : August 8, 1989

INVENTOR(S) : Lloyd B. Smith

It is certified that error appears in the above-identified patent and that said Letters Patent is hereby corrected as shown below:

Column 7, line 16, that portion of claim 3 reading "form" should read --from--.

Column 8, line 13, that portion of claim 3 reading "gates" should read --negates--.

Column 8, line 13, "particular te" should read --particulate--.

Signed and Sealed this

Twentieth Day of November, 1990

*Attest:*

*Attesting Officer*

HARRY F. MANBECK, JR.

*Commissioner of Patents and Trademarks*